United States Patent [19]

Swenson

[11] Patent Number: 4,588,387

[45] Date of Patent: May 13, 1986

[54] ILLUMINATED INFANT TOY

[75] Inventor: Paula S. Swenson, Lakewood, Colo.

[73] Assignee: Neptune Corporation, Lakewood, Colo.

[21] Appl. No.: 583,633

[22] Filed: Feb. 27, 1984

[51] Int. Cl.[4] ..... A63H 33/26; A63H 5/00

[52] U.S. Cl. ..... 446/130; 446/419; 446/485; 362/205; 362/802

[58] Field of Search ..... 446/485, 484, 404, 439, 446/438, 130, 418, 419, 421, 219, 242, 397; 362/202, 203, 204, 205, 206, 802, 806

[56] References Cited

U.S. PATENT DOCUMENTS

| | | | |
|---|---|---|---|
| 1,780,004 | 10/1930 | Connelly | 362/205 |
| 1,959,835 | 5/1934 | Meginniss . | |
| 2,484,159 | 10/1949 | Flynn, Jr. | 362/802 X |
| 2,493,491 | 1/1950 | MacMahon . | |
| 2,634,407 | 4/1953 | Johnson . | |
| 2,972,739 | 2/1961 | Opper . | |
| 3,304,651 | 2/1967 | Deyerl | 446/439 |
| 3,391,935 | 7/1968 | Gross . | |
| 3,584,212 | 6/1971 | Hansen | 362/802 X |
| 3,792,389 | 2/1974 | Murphy | 362/205 X |

*Primary Examiner*—Mickey Yu

*Attorney, Agent, or Firm*—Fields, Lewis, Pittenger & Rost

[57] ABSTRACT

A rattle for an infant is provided wherein the noise making device within the rattle also is a light activation device to momentarily light, in sequence, a plurality of lights mounted on the rattle. The noise-making device is made of magnetic material and is moved back and forth in a tube within the rattle so as to activate reed switches adjacent to the tube thereby sequentially illuminating the lights. The device is powered by batteries mounted in a handle on the rattle.

15 Claims, 3 Drawing Figures

ILLUMINATED INFANT TOY

DESCRIPTION

1. Technical Field

This invention relates to an illuminated infant toy, and more particularly to a rattle for a infant wherein the device which makes the rattling noise also functions to cause the rattle to be intermittently illuminated.

2. Background Art

Various toys and other devices have been provided in the prior art wherein a ball is rolled along a predetermined path to cause one or more lights to be illuminated.

One such device is shown in U.S. Pat. No. 3,391,935 to Gross wherein a toy, having batteries located in the handle connected through a circuit means to a lightbulb for illuminating the toy. The toy includes nested conical elements, supported by the handle and having electrical switches along the side surfaces thereof. A ball is provided within the device which is manipulated between the nested conical members and every time it passes over one of the switches, it closes the circuit and momentarily illuminates the light.

A flashlight switching device is shown in U.S. Pat. No. 1,959,835 to Meginniss wherein a pair of spring clips are provided at one end of a chamber and a pair of similar clips are provided at the other end of the chamber and connected in circuit to a lightbulb. The lightbulb is illuminated when a conducting ball is in engagement with the latter pair of clips. When it is desired to have the flashlight turned off, the flashlight is shaken or jarred so that the ball falls into the other pair of clips.

U.S. Pat. No. 2,493,491 to MacMahon discloses a two-headed flashlight with a passageway between dry cells, one dry cell being for each light. A steel conducting ball rolls along a passageway to one end or the other of the flashlight to alternately illuminate the lamps at opposite ends. The lamp can be turned off completely by allowing the ball to fall into a recess intermediate the passageway.

A flashlight having three contacts connected in series as shown in U.S. Pat. No. 2,972,739 to Opper. The circuit to the flashlight is closed when a conducting ball, which can roll along a pathway, contacts any one of the contacts positioned in the pathway. If the flashlight is pivoted to cause the ball to roll between alternate pairs of contacts, the light will be alternately turned on and off. If the flashlight is rotated so that the ball falls into a recess to contact the third contact, the flashlight will remain illuminated. When it is desired to turn the flashlight off, it can be manipulated so that the ball falls into a recess and does not touch any of the contacts.

U.S. Pat. No. 2,634,407 to Johnson discloses an intermittently activated light for use by hunters as a safety device. In this device, a contact prong is mounted on the end of a spring and electrically connected to the spring by a battery. Oscillations of the spring due to movement of the hunter will cause the contact to vibrate and alternately close the circuit to one or the other of a pair of lights mounted on the device and connected in the circuit.

Although each of these devices has been suitable for its intended purpose, none of them disclose a rattle for an infant wherein the noise producing means of the rattle serves as an activation for illuminating lights intermittently on the rattle.

DISCLOSURE OF THE INVENTION

In accordance with this invention a hand operated toy is provided which provides both a sound and illumination response to the user. The toy comprises a housing having a tube which has opposite closed ends. Noise-producing means is selectively movable back and forth within the tube from one end to the other creating a sound as it moves and upon impact with each end. A normally-open electrical switch means is mounted along the tube which is closed momentarily by the movable means each time it moves through the switch. A battery is mounted in the housing and light means in the housing is connected in circuit with the battery means and the switch means which is intermittently illuminated each time the switch means is closed by the movable means.

More specifically, the invention relates to an illuminated baby rattle having an elongated generally cylindrical housing with a longitudinal axis. A tube is provided within the housing lying along the axis and having opposite closed ends. A plurality of lights are spaced along the outside of the tube which are visible through the housing. A plurality of reed switches are spaced along the outside of the tube and have the same spacing as the light and a handle extends from one end of the housing. A battery compartment is provided in the handle for holding batteries and circuit means is connected to each in series with one of the reed switches to form a lighting set and the lighting sets are connected in parallel to the batteries. A magnet in the tube can be rolled from one end of the tube to the other by gravity upon tipping the rattle back and forth to make a noise as it rolls back and forth through the tube. The magnet sequentially closes the reed switches as it rolls to sequentially illuminate lights. In one embodiment, the magnet is spherical and in another embodiment it is a disk which can roll end over end. Conveniently, the lights may be in the form of light emitting diodes spaced along the housing. A normally-open master switch can be provided in the end of the handle and connected in series with the batteries for activating the circuit.

Thus, a rattle for an infant is provided wherein the device which creates the sound in the rattle is made of magnetic material and performs the dual function of closing reed switches connected in circuit with light emitting diodes so that upon movement of the sound producing device through a tube in the rattle, the light emitting diodes will be sequentially lighted adding to the enjoyment of playing with the rattle.

Additional advantages of this invention will become apparent from the description which follows, taken in conjunction with the accompanying drawings.

BEST MODE FOR CARRYING OUT THE INVENTION

Figure 1:
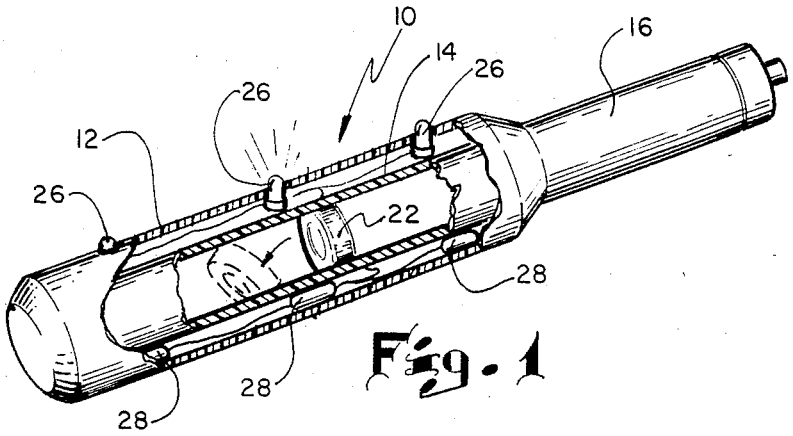
FIG. 1 is a perspective view of the illuminated rattle of this invention, with parts broken away for clarity of illustration.
Figure 2:
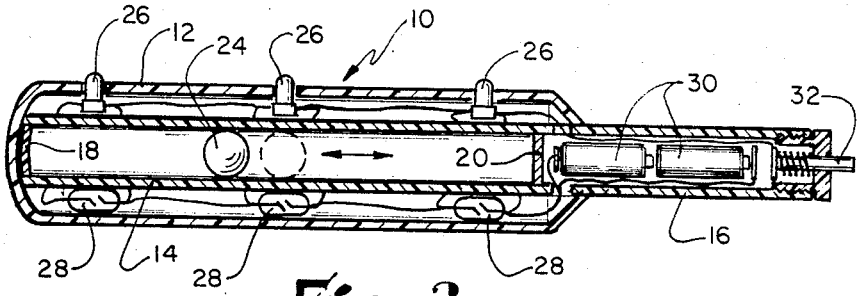
FIG. 2 is a horizontal section through the rattle of FIG. 1 showing further details thereof.

In accordance with this invention, a rattle 10 is provided which has a generally cylindrical housing 12 which contains a tube 14 that lies along the axis of the housing. Conveniently, tube 14 extends beyond the housing at one end to form a handle 16 for manipulating the rattle. As best seen in FIG. 2, tube 14 has a first closed end 18 and a second closed end 20 between which a sound producing device such as disk 22 in FIG. 1 or ball 24 in FIG. 2 can roll to produce a noise and to illuminate the device as described below. In this regard, disk 22 will roll end over end as illustrated in FIG. 1 and ball 24 will roll along the tube.

Figure 3:
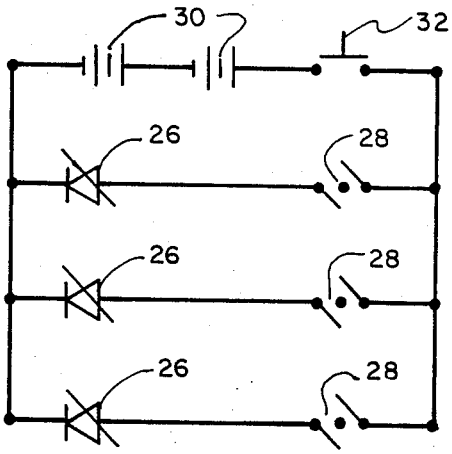
FIG. 3 is a diagram of the electrical circuit for the rattle.

Conveniently, a plurality of lights such as light emitting diodes 26 is mounted along one side of tube 14 and extend through the side of housing 12, as shown. They are each connected in series with reed switches 28 to form separate light sets of a light emitting diode 26 and a reed switch 28. These light sets are then connected in parallel, as best seen in FIG. 3, to batteries 30 mounted in handle 16, as shown in FIG. 2. If desired, a push button switch 32 can be provided in the circuit and is mounted on the end of handle 16. Conveniently, disk 22 and ball 24 are made of magnetic material so that when they roll past the reed switches, they will be momentarily closed causing their respective light emitting diodes to be illuminated creating a pleasing effect for the infant or child who is playing with the rattle.

It will be understood that push button switch 32 is optional. If it is not in the circuit, then every time the rattle is tipped back and forth, the rolling ball or disk will make a noise as it rolls through the tube and will sequentially and momentarily illuminate each of the light emitting diodes. With the push button switch 32 in the circuit, it is necessary for the infant playing with the rattle to depress the switch in order to cause the lights to be illuminated upon manipulation of the rattle. Conveniently, when the device is provided with disk 22, the disk will roll end over end and will actually momentarily illuminate an LED 26 two times with each passage since the disk will turn end over end causing the reed switch to be closed twice with each passage of the disk. It will be understood that either the disk or the ball will be used but not both at the same time. Since the ball is also magnetic, it will also close each of the switches as it passes over it.

Advantageously, the LEDs may be of different colors to further enhance the enjoyment of playing with the rattle.

From the foregoing, the advantages of this invention are readily apparent. A rattle has been provided wherein the noise making device within the rattle services a dual purpose of not only making noise but also providing intermittent illumination of the device to further enhance the enjoyment of playing with it. This is accomplished by connecting light-emitting diodes in series with reed switches that are momentarily closed by the noise-making device which is made of magnetic material causing the reed switches to close as it passes over them.

The invention has been described in detail with particular reference to preferred embodiments thereof, but it will be understood that variations and modifications can be effected within the spirit and scope of the invention.

What is claimed is:

1. A hand operated toy which provides both a sound and illuminated response to the user, said toy comprising;

a housing having a tube which has opposite closed ends;

noise-producing means selectively movable back and forth within said tube from one said end to the other creating a sound upon impact with each said end;

a plurality of normally-open electrical switches spaced along said tube between said ends which is closed momentarily and sequentially by said noise-producing means each time it moves through said tube from said one end thereof to the other;

battery means mounted in said housing; and light means in said housing connected in circuit with said battery means and said switches which is intermittently and sequentially illuminated each time said switches are closed momentarily and sequentially by said noise-producing means moving along said tube.

2. Apparatus as claimed in claim 1, wherein:

said switches are reed switches; and said noise-producing means is made of magnetic material which momentarily closes each of said switches as it passes them.

3. Apparatus, as claimed in claim 2, wherein:

said noise-producing means is spherical.

4. Apparatus, as claimed in claim 2, wherein;

said noise-producing means is a disk which is rollable end over end through said tube to close at least some of said switches twice with each pass of said noise-producing means.

5. Apparatus, as claimed in claim 1, wherein said light means includes:

a plurality of lights spaced along said housing.

6. Apparatus, as claimed in claim 1, further including:

a handle made as an extension of said tube and containing said battery means.

7. An intermittently illuminated baby rattle, said rattle comprising:

an elongated, generally cylindrical housing having a longitudinal axis;

a tube within said housing lying along said axis and having opposite closed ends;

a plurality of lights spaced along the outside of said tube which are visible through said housing;

a plurality of reed switches spaced along the outside of said tube and having the same spacing as said lights;

a handle extending from one end of said housing;

a battery compartment in said handle for holding batteries;

circuit means connecting each said light in series with one of said reed switches to form a lighting set and connecting each lighting set in parallel to said batteries; and a sound producing magnet in said tube which creates a sound as it rolls from one end of said tube to the other by gravity upon tipping the rattle back and forth, said magnet sequentially closing said reed switches to sequentially illuminate said lights as it rolls through said tube and creating a sound as it rolls and as it strikes each end of said tube.

8. A rattle, as claimed in claim 7, wherein:

said magnet is spherical.

9. A rattle, as claimed in claim 7, wherein:

said magnet is a disk.

10. A rattle, as claimed in claim 7, wherein:

said handle is formed as an extension of said tube.

11. A rattle, as claimed in claim 7, wherein:

said lights each are of a different color.

12. A rattle, as claimed in claim 7 wherein:

said lights are each a light emitting diode.

13. A rattle, as claimed in claim 7, wherein said circuit means further includes:

a normally-open master switch in said handle in series with the batteries.

14. A rattle, as claimed in claim 13, wherein:

said master switch is actuated by a push button in the end of said handle.

15. A hand operated amusement device with sound and illumination which can be manipulated to provide a recognizable response to the user, said device comprising;

a housing having a passagway which has opposite closed ends;

means selectively movable back and forth within said passageway from one said end to the other;

a plurality of normally-open electrical switches spaced along said passageway between said ends which is closed momentarily and sequentially by said movable means each time it moves through said passageway from one of said ends to the other;

battery means mounted in said housing; and responsive means in said housing connected in circuit with said battery means and said switches which is intermittently activated each time said switches are closed by said movable means moving along said passageway.

* * * * *